United States Patent [19]

Balon, Jr. et al.

[11] Patent Number: 4,929,262

[45] Date of Patent: May 29, 1990

[54] DOWN DRAFT RE-CIRCULATING SYSTEM

[76] Inventors: John Balon, Jr., 25 Jefferson Rd., Bedford, N.H. 03102; Richard J. Egan, 6 Springdale Rd., Manchester, N.H. 03103

[21] Appl. No.: 134,184

[22] Filed: Dec. 17, 1987

[51] Int. Cl.[5] ..... B01D 46/00

[52] U.S. Cl. ..... 55/341.2; 55/467; 55/487; 55/DIG. 29; 98/40.1

[58] Field of Search ..... 55/487, 486, 485, 467, 55/DIG. 29, 97, 323, 334, 341.2; 98/40.19, 40.1, 33.1

[56] References Cited

U.S. PATENT DOCUMENTS

| | | | |
|---|---|---|---|
| 2,214,821 | 9/1940 | Lucius | 98/40.1 |
| 3,201,926 | 8/1965 | Harrington | 55/486 |
| 3,347,025 | 10/1967 | Wiley | 55/473 |
| 3,657,992 | 4/1972 | Minnick | 55/485 |
| 3,824,909 | 7/1974 | Horneff et al. | 98/33.1 |
| 4,339,250 | 7/1982 | Thut | 55/316 |
| 4,370,155 | 1/1983 | Armbruster | 55/316 |
| 4,603,618 | 8/1986 | Charles | 98/31.5 |
| 4,604,111 | 8/1986 | Natale | 98/33.1 |

*Primary Examiner*—Bernard Nozick
*Attorney, Agent, or Firm*—Lee A. Strimbeck

[57] ABSTRACT

A down draft air re-circulating filtration system for auto body shops and the like companies a filtration unit intaking air from the floor and having a series of three filters removing particles greater than about 1 micron and a fabric ducting distributing the filtered air at a multiplicity of points just under the ceiling to create a "blanket" of filtered air under positive pressure that settles towards the floor and the filtration unit intake.

4 Claims, 1 Drawing Sheet

DOWN DRAFT RE-CIRCULATING SYSTEM

Figure 1:
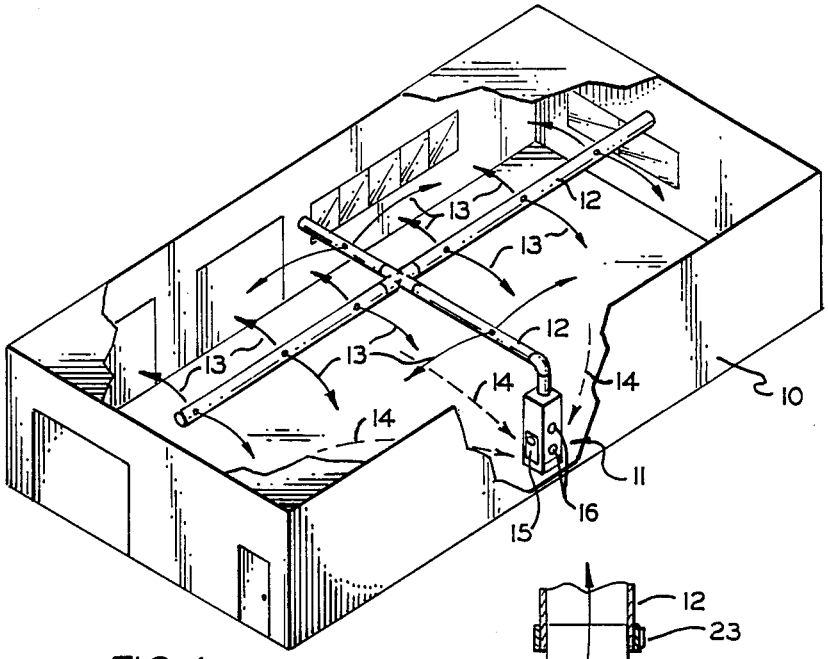

This invention is concerned with a down draft recirculating air filtration system particularly useful in enclosed environments, especially in those wherein airborne contaminates are constantly being generated such as in automobile body and service shops. It is particularly concerned with the removal of health hazardous dust and paint particles.

PRIOR ART

| PRIOR ART | | |
|---|---|---|
| U.S. Pat. No. 4,339,250 | Thut | 7/13/82 |
| U.S. Pat. No. 4,603,618 | Charles | 8/5/86 |
| U.S. Pat. No. 4,370,155 | Armbruster | 1/25/83 |

These patents are concerned with the filtering and re-circulating of air in enclosed environments. However, they do not disclose the particular floor mounted filtering system used by the applicant in conjunction with the uniform controlled distribution of the recirculated air across the ceiling of the enclosed space by means of an elongated duct thereunder.

BACKGROUND

There are many situations where in an enclosed environment suspended particulate matter is being constantly generated which particulate material is often deleterious to the workers in the room and/or the product being produced. Particularly bad offenders in this regard are machine and metal working shops and automobile service areas and body shops. Many systems have been proposed for the filtering of the air in such enclosed environments, but none to date have been entirely satisfactory at a reasonable price. For example, electrostatic precipitators have been hung from a shop ceiling with the air being circulated in series through them to remove the particulate matter and other contaminates. Besides the fact that the electrostatic precipitators at the ceiling level are difficult to service—and they do require regular cleaning—this arrangement requires that the air from the floor of the shop be drawn up past the workers on the floor to the electrostatic units, giving the workers a better opportunity to inhale the contaminated air.

In another system, the filtering unit is placed on the floor and the filtered area air is blown toward the ceiling without proper distribution through a duct. Undue turbulence results and the distribution of the air is not uniformed throughout the enclosed space. When the room is heated, the warmer air tends to collect underneath the ceiling and if proper distribution of the filtered air is not observed, localized air circulation cells may be set up that will draw the contaminated air to the ceiling, rather than allow it to flow along the floor to the filtration unit.

There has been a desideratum therefore for a cost and performance effective air filtration/air distribution system for enclosed environments to purify contaminated air therein. There has been a need for an effective re-circulating air filtration system that is mechanically uncomplicated and easy to service and maintain.

The present invention proposes such a system.

INVENTION

In brief compass, this invention is a down draft re-circulating air filtration system for an enclosed space comprising a filtration unit and a duct receiving air from the air filtration unit and distributing the same through a multiplicity of outlets across and just under the ceiling of the enclosed space. The filtration unit intakes air from the floor of the enclosed space and has a fan to propel the air into and through the duct. Upstream of the fan in the filtration unit there are at least three easily removable filter elements through which the air passes in series.

The first filter is a coarse filter of a non-woven fiber mesh on the outside of the base of the unit. This filter is held largely by the airflow into the unit pushing it against a supporting grid such that it is easily removable for daily shake out or cleaning.

The second filter within the unit consists of a commercially available cap-shaped filter of plastic fibers coated with a tackifier. It removes 95% of all particles in the contaminated air greater than 10 microns. The cap-shaped filter is held on a frame within the unit simply by a hook and loop fabric fastener (Velcro) such that it could be readily removed and replaced. The fibrous filtering mat is preferably of three ply construction of crimped polyester fiber with the outer ply having a coarser more open structure and the inner ply the finest interstices. The middle ply preferably contains a tackifier to assure filter cake build-up.

The third filter is a commercially available bag filter that removes 95% of all particles greater than 1 micron. The bag filter consists of several pockets mounted on a frame or hoop. The hoop, with the filter, can readily be removed from the filtration unit for shaking out or for such other cleaning or replacement as may be desired.

The ducting used for distributing the filtered air is preferably of a reinforced plastic fabric in the form of a tube. It has a multiplicity of openings cut in the tube along its length to direct the air against the ceiling of the enclosed space. The filtered air because it is dispersed at a multiplicity of points directly underneath the ceiling, gently mixes with the warm air layer against the ceiling to form a "blanket" which for any lot of air gently drifts downwardly to the floor of the enclosed space without appreciable turbulence or the formation of localized air circulation cells that would serve to stir up the dust from the floor. This "blanket" when approaching or reaching the floor, gently drifts along the floor to the air intake of the filtration unit.

This down flow or down draft system keeps particulate matter, dust or fumes being generated in an enclosed space from traveling upwardly and/or laterally which if they do, tend to cause worker irritation and perhaps contamination of adjacent work projects. For example, in an auto body shop at one station a car maybe being painted while at an adjacent station, a car maybe being sanded and primed to prepare it for painting. If the dust being generated from the sanding operation were allowed to drift over to the spray painting operation, it could spoil the paint finish.

DRAWINGS

Figure 2:
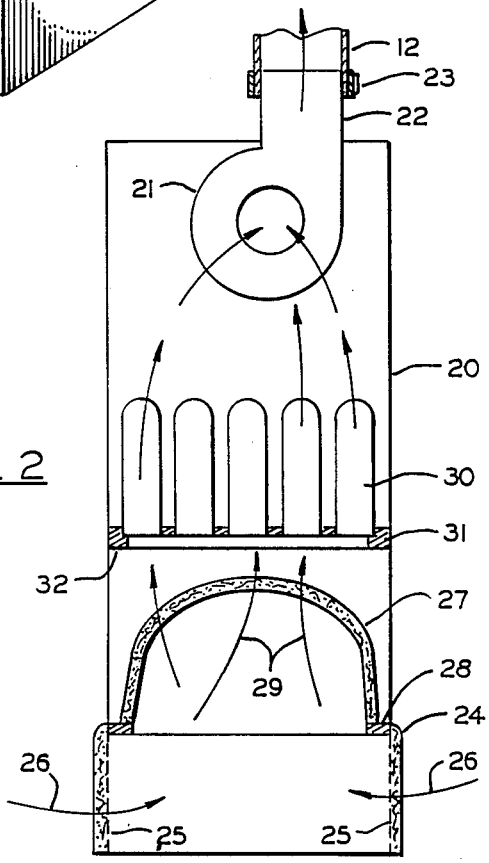

In the drawings:

FIG. 1 illustrates an enclosed spaced or work area to which this invention is applied and, FIG. 2 is a schematic illustration in cross section of the filtration unit of this invention.

DESCRIPTION

With reference to FIG. 1, an enclosed space 10 e.g. an automobile service area generating particle laden air, contains a filtration unit 11 of this invention. Filtered air from the filtration unit 11 is passed up to the ceiling and along underneath the ceiling by fabric ducting or pipes 12. This ducting has a series of openings cut into it, preferably at 10:00 and 2:00 o'clock in cross section, which allow the filtered air to exit from the ducting up against the ceiling and to flow thereover as indicated by the arrows 13, mixing with the warm air that tends to collect at the ceiling. This pattern of distribution creates a "blanket" of filtered air at the ceiling under a positive pressure with respect to the pressure of the air at the floor of the enclosed space 10. As the filtered air is admitted underneath the ceiling to the "blanket" through a multiplicity of outlets, there is no violent turbulence and swirling and mixing the air as is the case if there is simply but one or two outlets or if the air is being blown up from a filtration unit on the floor without the use of ducting.

Because of the pressure differential that exist between the ceiling and that of the floor, the "blanket" with regard to any one unit of air tends to settle gently towards the floor. The fumes and dust thus being created in the work area are carried downward with this "blanket" to the floor with little turbulence other than that caused by the work going on in the enclosed space. Near or at the floor, the air travels across the floor as indicated by directional areas 14 to the filtration unit 11 of this invention to be cleansed and recirculated.

Filtration unit 11 has a door or upward removable panel 15 that permits access to the filters in the unit. It also preferably has means for observing the pressure drops over the second and third stage filters, which pressure drops may be displayed by gages 16 on the side of the unit. The observing of these pressure drops aid in determining when the filters should be removed and cleaned.

With reference to FIG. 2, the filtration unit of this invention comprises a cabinet 20, having at the top a blower or fan 21 exhaust the air via an outlet 22 which connects to the ducting 12. The ducting can be held on oulet 22 by a suitable clamp 23.

The first or coarse filter 24 is wrapped around the base of the unit on three sides. The filter is supported against a grid 25. Filter 24 consists of a heavy bat of non-woven fibers which is pretty much self supporting. It is held against the grid 25 by means of the incoming air flow indicated by arrows 26. If desired, filter 24 can be held in place by a spring clip or a hook and loop fabric fastener spotted along the circumference.

The second filter is a cap-filter 27 held by a hoop 28 with the hoop being attached to a circumferential frame in the unit as by means of a hook and loop fabric fastener.

Filter 27 preferably consists of a three ply mat of crimped plastic fibers with the fibers being more coarsely layed or more open on the side facing the air flow, indicated by directional arrows 29.

The air exiting filter 27 passes through a bag filter 30 having several pockets mounted on a hoop or framed 31. Hoop 31 again is desirably held within the unit on a rim 32 by means of a hook and loop fabric fastener.

The cap filter and the bag filter can be readily removed by removing access door 15 and simply lifting the filters out.

As previous indicated, the cap filter removes 95% of all particles greater than 10 microns in size, and the bag filter removes 95% of all particles greater than 1 micron in size. If there is no dust or other contamination being continuously generated in enclosed space 10 the constant re-circulation of air through the filtration unit 20 would in short order remove practically all contamination greater than 1 micron in size.

With auto body shops and other operations, there will be paint fumes and blower 21 is desirably explosion proof.

It has been found that as this down draft filtration system of the present invention causes heat collecting at the ceiling to migrate downward to the floor of the enclosed space, there is a substantial savings in heating cost. There is less heat lost through the ceiling of the enclosed space and as the heat is more uniformly distributed the workers feel more comfortable with, consequently, less heat input being required.

The system of the present invention has been installed in several automobile service areas and body shop facilities. The results have been truly impressive. The air in which the workers must work is substantially cleaner and there has been a reduced amount of headaches and absenteeism. Employee moral and efficiency were improved. As indicated above, the heating costs were reduced and there was substantially less grime and dust on the walls of the shops. Purchasers of the systems were pleased with their easy maintenance. Among other things it was not necessary for them to deal with ceiling suspended units.

We claim:

1. A down draft air recirculating filtration system for an enclosed space comprising in combination: a floor mounted filtration unit and a flexible fabric duct receiving air from said filtration unit and adapted to distribute the same through a multiplicity of outlets across and just under the ceiling of said enclosed space; said filtration unit being adapted to intake air from the floor of said enclosed space and having a fan to propel said air and upstream of said fan at least three filter elements in series through which said air passes, the first of which is a course filter, the second of which removes 95% of all particles greater than 10 microns and the third of which removes 95% of all particles greater than 1 micron, the second filter element being comprised of crimped fibers of plastic fiber coated with tackifier and the third filter being a bag filter, said filter elements being readily removable and replaceable in said filtration unit, said filtration system creating a blanket of filtered air at said ceiling under positive pressure and a zone of lower pressure at said floor, which filtered air drifts downwardly to said floor and to said filtration unit.

2. The system of claim 1 wherein said enclosed space is an automotive shop.

3. The system of claim 1 wherein said flexible fabric duct has a multiplicity of openings cut therein along the length to direct the filtered air against said ceiling.

4. In an enclosed space generating air borne particles, and air re-ciriculation filtration unit therein said air re-circulation unit comprising in combination; a floor mounted filtration unit and a flexible fabric duct receiving air from said filtration unit and adapted to distribute the same through a multiplicity of outlets across and just under the ceiling of said enclosed space, said filtration unit being adapted to intake air from the floor of said enclosed space and having a fan to propel said air and upstream of said fan at least three filter elements in series through which said air passes, the first of which is a coarse filter, the second of which removes 95% of all particles greater than 10 microns and the third of which removes 95% of all particles greater than 1 micron, the second filter element being comprised of cramped fibers of a plastic fiber coated with a tackifier and the third filter being a bag filter, said filter elements being readily removable and replaceable in said filtration unit, said filtration system creating a blanket of filtered air at said ceiling under positive pressure and a zone of lower pressure at said floor which filtered air drifts downwardly to said floor and to said filtration units.

* * * * *